US006808427B1

(12) United States Patent
Xue

(10) Patent No.: US 6,808,427 B1
(45) Date of Patent: Oct. 26, 2004

(54) ELECTRICAL CONNECTOR WITH ANTI-MISMATING DEVICE

(75) Inventor: Yalei Xue, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/625,238

(22) Filed: Jul. 22, 2003

(30) Foreign Application Priority Data

Apr. 4, 2003 (TW) ..... 92205311 U

(51) Int. Cl.[7] ..... H01R 13/64
(52) U.S. Cl. ..... 439/676
(58) Field of Search ..... 439/680, 490, 439/676, 677, 679, 678, 296

(56) References Cited

U.S. PATENT DOCUMENTS 6,186,835 B1 2/2001 Cheshire
6,257,935 B1 7/2001 Zhang et al.
6,283,796 B1 9/2001 Yeh
6,312,293 B1 * 11/2001 Wang ..... 439/677
6,350,156 B1 2/2002 Hasircoglu et al.
6,354,884 B1 * 3/2002 Yeh et al. ..... 439/680
6,431,919 B1 * 8/2002 Wang et al. ..... 439/680

* cited by examiner

*Primary Examiner*—J. F. Duverne
(74) *Attorney, Agent, or Firm*—Wei Te Chung

(57) ABSTRACT

An electrical connector for mating with a complementary plug connector includes an insulative housing (3) having two sidewalls (32) and a receiving cavity (34) for receiving the plug, a number of terminals (21) having contact portions (211) extending into the receiving cavity and an anti-mismating devices (4). At least one of the sidewalls of the housing defines a window (321) therein and a retention groove (312) adjacent to the window. The anti-mismating device includes a locking portion (41), an elbow portion (42) extending downwardly and rearwardly from a front portion of the locking portion and a stopping tab (45) extending inwardly from the elbow. The elbow and the stopping tab are inserted into the receiving cavity through the window. The locking portion is secured in the retention groove.

10 Claims, 5 Drawing Sheets

ELECTRICAL CONNECTOR WITH ANTI-MISMATING DEVICE

BACKGROUND OF THE INVENTION

1. Field of the Invention

The present invention relates to electrical connectors and more particularly, to an electrical connector having an anti-mismating device therein for selectively receiving a specific sized mating connector.

2. Description of the Related Art

RJ-11 and RJ-45 receptacles respectively engaging with RJ-11 and RJ-45 plugs are commonly used in network communications. RJ-45 receptacle and plug have larger dimensions than RJ-11 receptacle and plug. Therefore, an RJ-11 plug may be inadvertently inserted into an RJ-45 receptacle, which may result in damage to the terminals of the RJ-45 receptacle. U.S. Pat. No. 6,350,156 issued to Hasircoglu on Feb. 26, 2002 disclosed a modular jack for receiving an RJ-45 plug and blocking an RJ-11 plug. The Hasircoglu modular jack comprises a housing having a plug-receiving cavity, terminals mounted in the housing and deflection members provided on each side of the plug receiving cavity. Each deflection member has a retention section, a ramp surface and a blocking tab extending transversely from an end of the ramp surface. The retention sections are held in slots of the housing and the blocking tabs extend inwardly. The ramp surfaces are disposed such that when the RJ-45 plug is inserted into the plug-receiving cavity, a leading edge of the RJ-45 plug deflects the ramp surfaces. The blocking tabs are deflected upwardly such that stopping tabs do not interfere with insertion of the RJ-45 plug. Upon insertion of the RJ-11 plug, a leading edge of the RJ-11 plug strikes the blocking tab and was prevented from being inserted further.

However, the Hasircoglu retention sections are inserted into the slots from a mating face of the housing along a plug insertion direction. The retention sections are likely to being pulled out of the slots after repeated insertion and withdraw of the plugs.

Hence, an electrical connector with reliable anti-mismating device is needed to overcome the foregoing shortcomings.

BRIEF SUMMARY OF THE INVENTION

A main object of the present invention is to provide an electrical connector with a reliable anti-mismating device for blocking insertion of smaller sized connectors.

Another object of the present invention is to provide an electrical connector with an electrical connector having anti-mismating device for ESD, which can be easy and reliably retained therein and assuring an electrical connection with a shield of a complementary plug connector.

In order to achieve the object set forth, an electrical connector comprises an insulative housing having two sidewalls and a receiving cavity for receiving a complementary plug, a plurality of terminals having contact portions extending into the receiving cavity of the housing and an anti-mismating devices. At least one of the sidewalls of the housing defines a window therein and a retention groove adjacent to the window. The anti-mismating device comprises a locking portion, an elbow portion extending downwardly and rearwardly from a front portion of the locking portion and a stopping tab extending inwardly from the elbow. The elbow and the stopping tab are inserted into the receiving cavity of the housing through the window. The locking portion is secured in the retention groove.

Other objects, advantages and novel features of the invention will become more apparent from the following detailed description when taken in conjunction with the accompanying drawings.

DETAILED DESCRIPTION OF THE INVENTION

Figure 1:
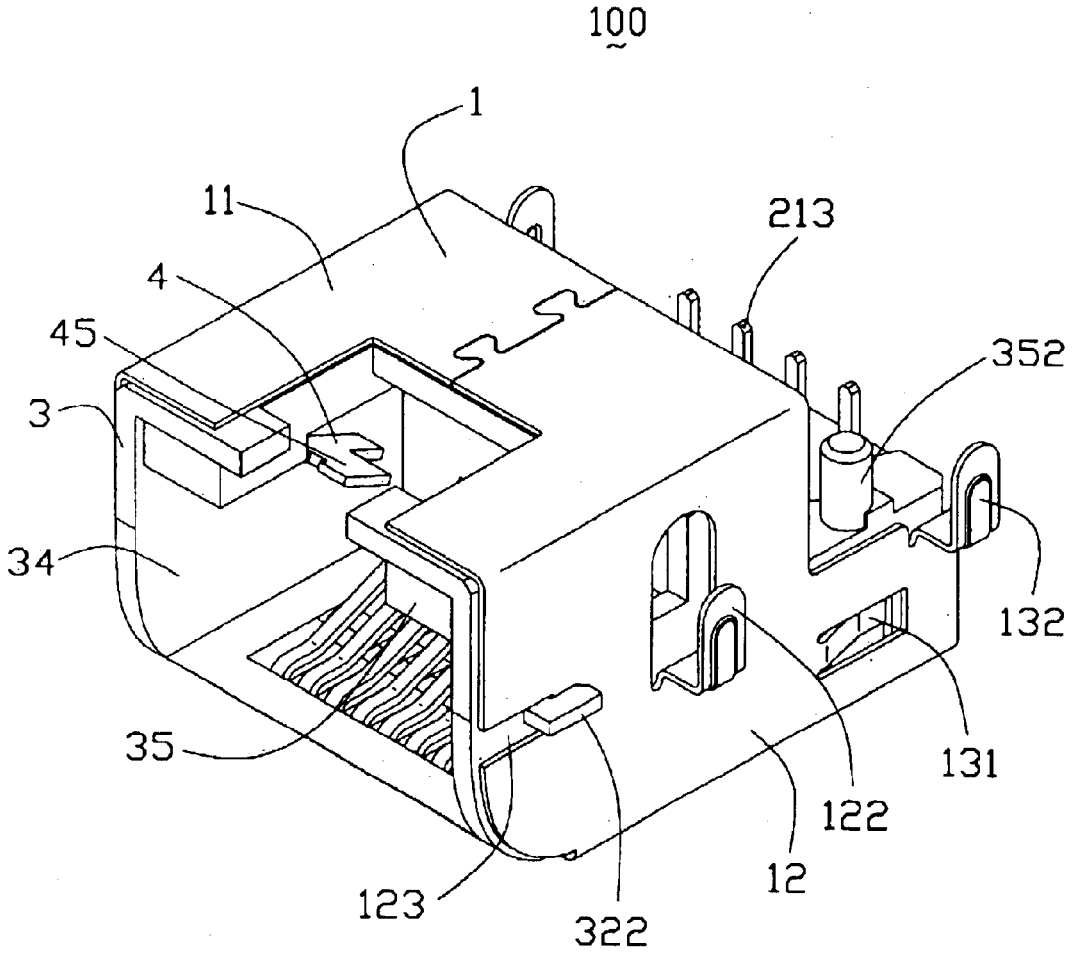
FIG. 1 is a perspective view of an electrical connector according to the present invention.
Figure 2:
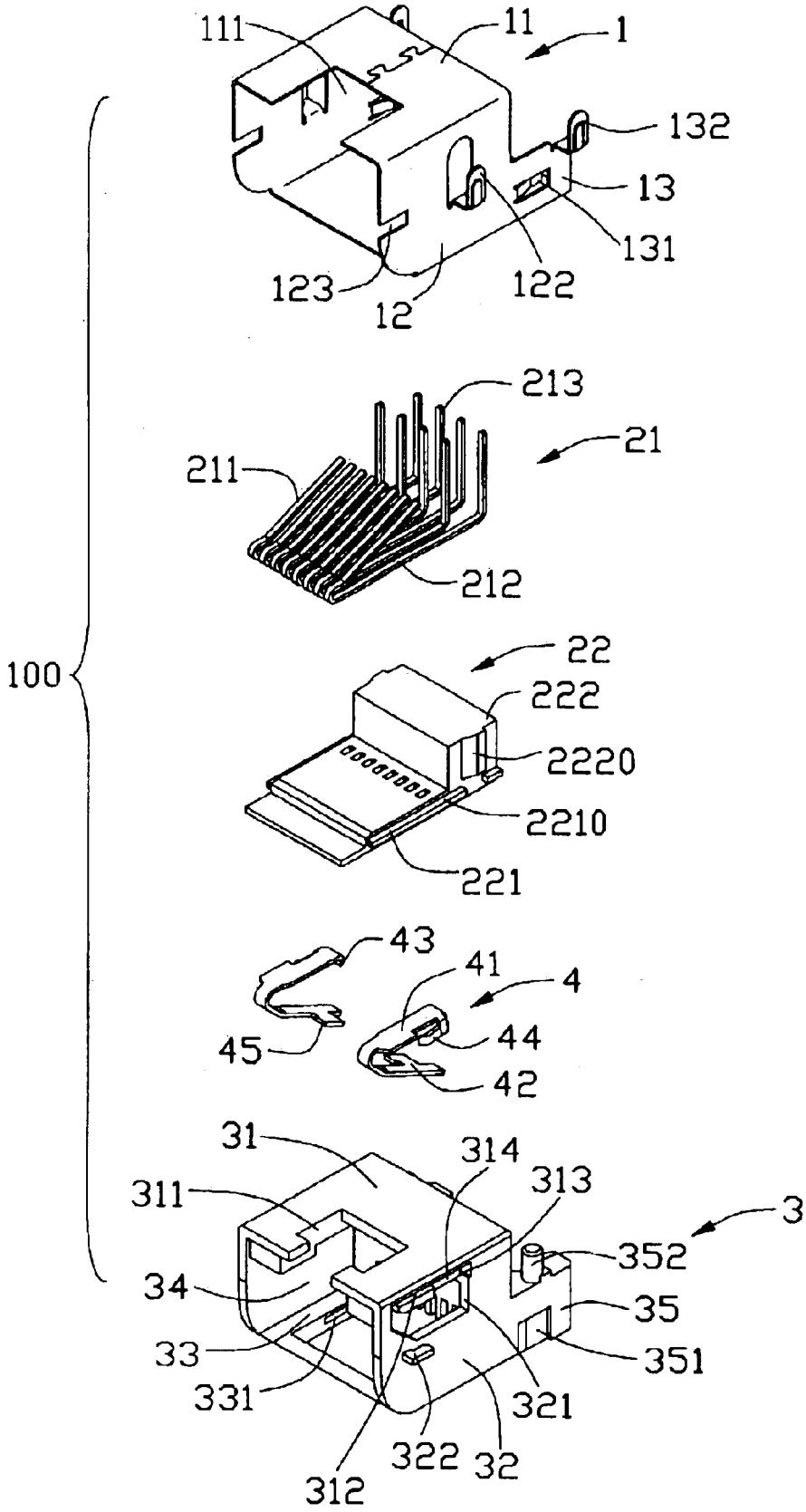
FIG. 2 is an explode view of FIG. 1.

Referring to FIGS. 1 and 2, an electrical connector 100 in accordance with the present invention is adapted for receiving a mating plug such as an RJ-45 type plug (not shown). The electrical connector includes a shield 1, an insulative housing 3, an insulator 22 with a plurality of terminals 21 insert molded therewith and a pair of anti-mismating device 4.

The shield 1 is stamped from one metal sheet and is folded for surrounding and shielding the housing 1, which is not shown in detail. The shield 1 comprises an upper plate 11, two side plates 12 and a lower plate (not labeled). The upper plate 11 defines a first indentation 111 in a front portion of the upper plate therein. Each side plate 12 defines a notch 123 extending rearwardly from a front portion of the side plate therein, a first barb 122 stamped outwardly from a mid-portion of the side plate thereof and leaving an opening (not labeled) therein and an extending part 13 extending rearwardly from a rear portion of the side plate 12. Each extending part 13 includes a piece 131 stamped inwardly and a second barb 132 extending upwardly from a free portion.

The insulator 22 is substantially L-shaped and includes a horizontal section 221 and a vertical section 222. The horizontal section 221 forms a rib 2210 on opposite sides thereof. The vertical section 222 forms a projection 2220 for engaging with the housing 3 on opposite sides thereof.

Each terminal 21 includes a horizontal holder portion 212, a contact portion 211 extending upwardly and rearwardly from a front end of the holder portion 212 for electrical connecting with a mating plug (not shown) and a solder portion 213 extending upwardly from a rear end of holder portion 212 for connecting an external circuitry, such as traces on a printed circuit board (not shown).

Figure 3:
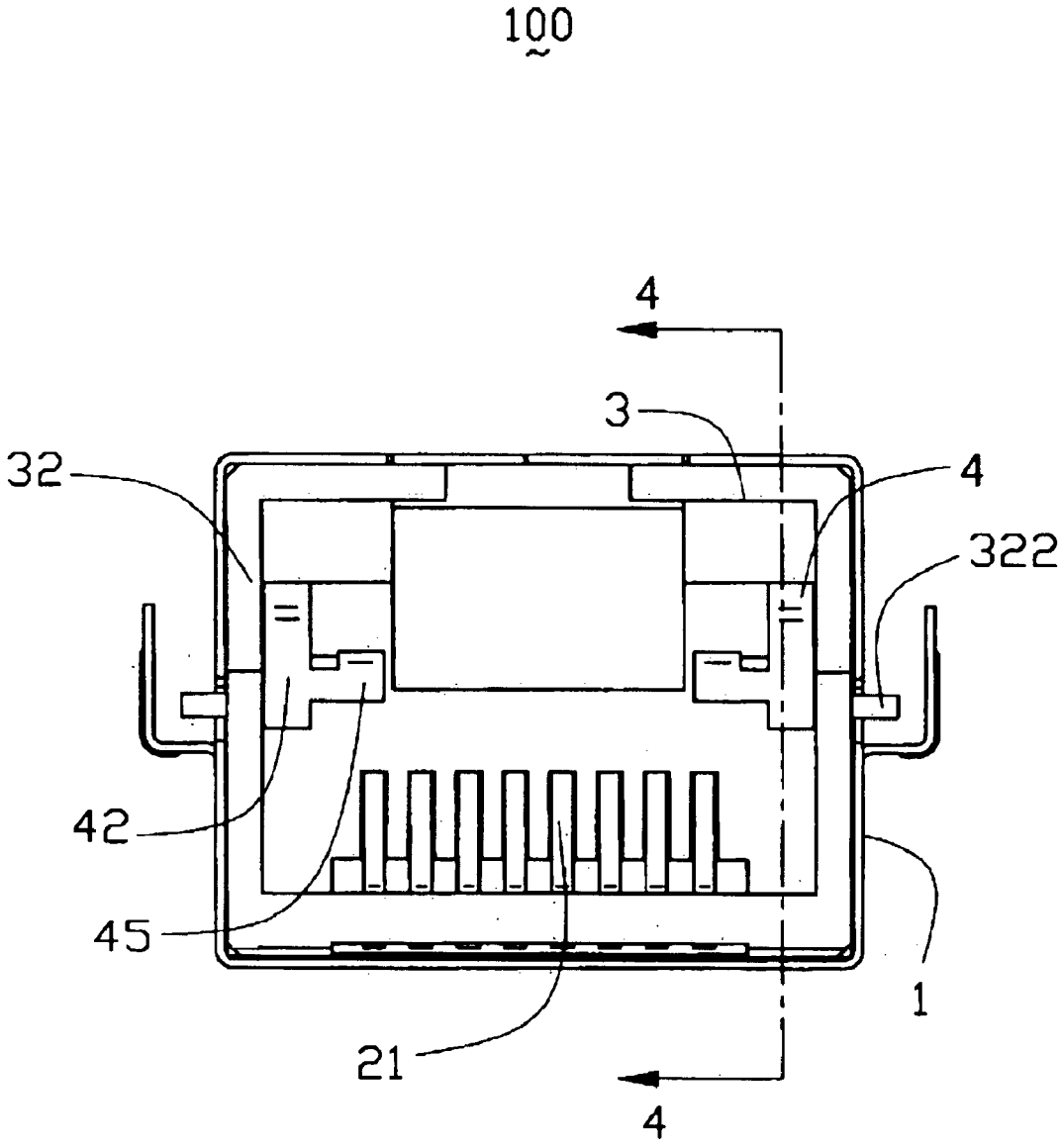
FIG. 3 is a front view of FIG. 1.
Figure 4:
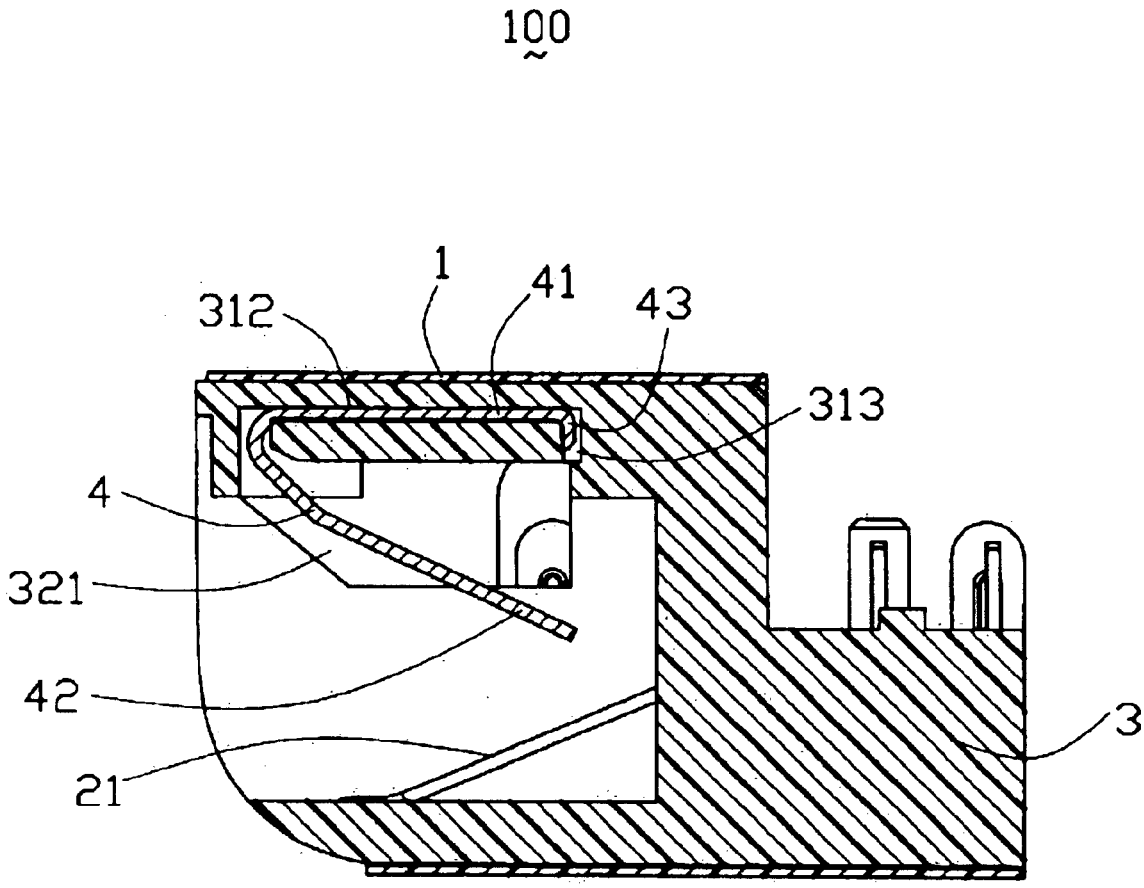
FIG. 4 is a cross-sectional view of the electrical connector taken along line 4—4 of FIG. 3
Figure 5:
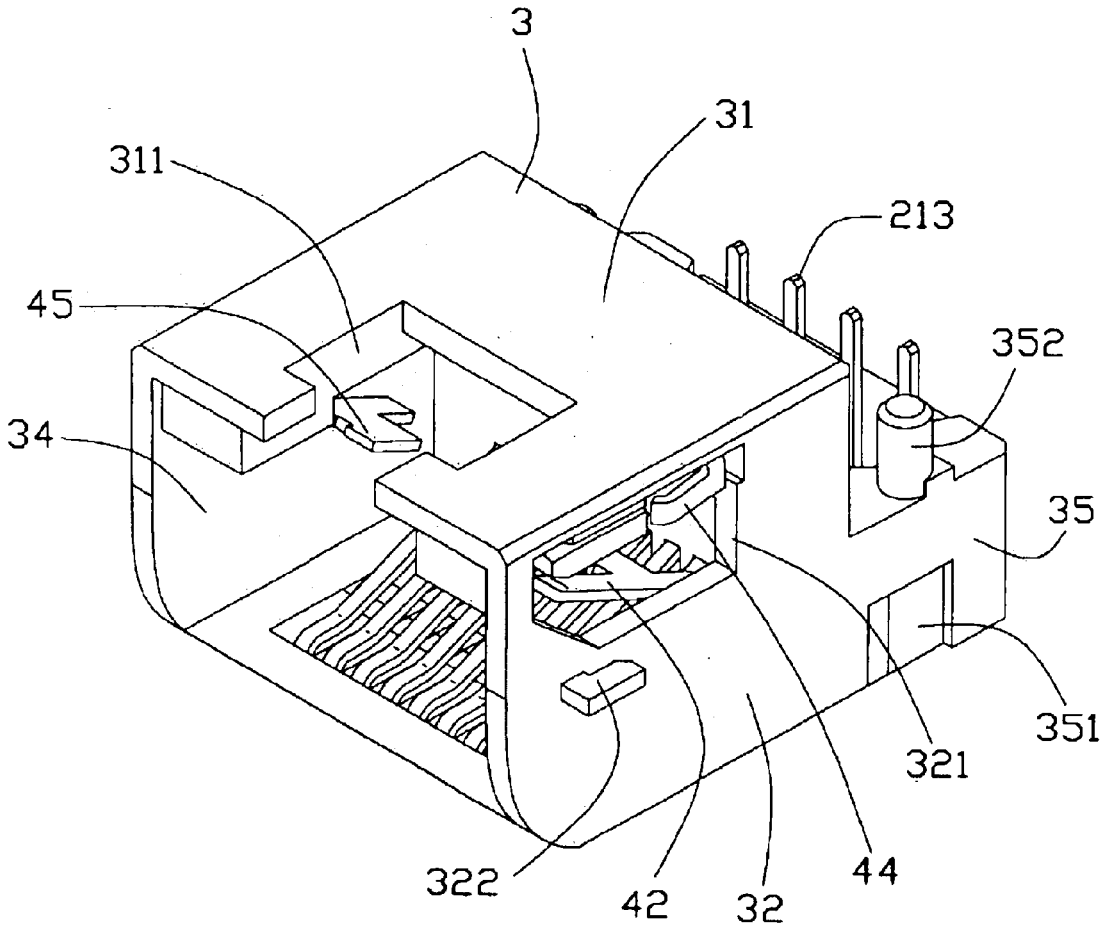
FIG. 5 is a partially assembled view of FIG. 1, wherein a shield is removed away.

Referring to FIGS. 2 through 4, the insulative housing 3 comprises an upper wall 31, two sidewalls 32, a bottom wall 33, a rear wall (not labeled) and a receiving cavity 34. The upper wall 31 defines a second indentation 311 communicated with the receiving cavity 34. Each sidewall 32 comprises a window 321, a protrusion 322 beneath the window 321, and a bulge 35 extending rearwardly. A pair of first retention groove 312 is defined in the upper wall 31 and exposed to corresponding sidewalls 32. A second retention groove 313 is defined in each side wall and communicates with the first retention groove 312. In this embodiment, an angle between the first and second retention grooves is a right angle. A slot 314 is disposed adjacent to the first retention groove 312 and runs into the window 321. Each bulge 35 includes a recess 351 in a lower portion thereof and a post 352 extending upwardly. The bottom wall 33 defines a pair of passages 331 for engaging with the ribs 2210 of the insulator 22.

Turning to FIG. 2, each anti-mismating device 4 is stamped and folded from one metal sheet and includes a flat locking portion 41, a retention portion 43 folded downwardly from a rear portion of the locking portion 41, an elbow 42 extending downwardly and rearward from a front portion of the locking portion 41, a stopping tab 45 extending inwardly from the elbow 42 and an insertion tab 44 extending downwardly from a rear side portion of the locking portion 41. An angle between the locking portion 41 and the elbow 42 of is an acute angle.

In assembly, as shown in FIGS. 1 through 5, the holder portions 212 of the terminals 21 is insert-molded with the horizontal section 221 of the insulator 22. The insulator 22 and the terminals 21 are assembled into the housing 3 with the ribs 2210 engaging with corresponding passages 331 of the bottom wall 33. The anti-mismating devices 4 are inserted into the housing from the sidewalls 32 of the housing 3 with each elbow 42 and each stopping tab 45 inserted into the receiving cavity 34 through the windows 321. The locking portions 41 and the retention portions 43 are received in the first and second retention grooves 312, 313 respectively. The insertion tabs 44 are received in the slots 314 of the upper wall 31 of the housing 3 and extending out of the sidewall 32. Subsequently, the shield 1 is folded to surrounding and shielding the housing 3. The notches 123 are latched with corresponding protrusion 322 of the sidewall. Each piece 131 of the extending parts 13 is engaged with a corresponding recess 351 of the bulge 35. The insertion tabs 44 of the anti-mismating device 4 abut against the side plates 12 of the shield 1. The present electrical connector 100 is mounted on an electronic appliance (not shown) with the first, second barb 122, 132 of the shield 1 and the post 352 of the housing 3 engaged with corresponding holes respectively.

Operation of the electrical connector 100 of the present invention will now be described. The RJ-45 plug (not shown) very nearly fills all of the plug receiving cavity 34 and substantially extends from interior sidewall 32 to opposing interior sidewall 32. In other words, the width of RJ-45 plug is adequate to snuggly fit with the receiving cavity 34 of the electrical connector 100. As such, the elbows 42 of the anti-mismating device 4 are engaged by the insertion end of the RJ-45 plug and are thus deflected upwardly as the RJ-45 plug is inserted into the receiving cavity 34. As the RJ-45 plug is further insert into the receiving cavity 34, the stopping tabs 45 are deflected upwardly and out of the RJ-45 plug insertion direction such that the stopping tabs 45 do not interfere with insertion of the RJ-45 plug. In this way, the plug can be successfully inserted into the electrical connector 100 whereby contacts of the RJ-45 plug can be electrically mated with the contact portions 211 of the terminals 2.

However, when an RJ-11 plug (not shown) is erroneously inserted through the receiving cavity 34, since the RJ-11 plug has a smaller width than the RJ-45 plug, the RJ-11 plug does not entirely fill the receiving cavity 34. As such, the inserted RJ-11 plug will not engage and push the elbows 42 aside, and the insertion of a latch of the RJ-11 plug into the receiving cavity 34 strikes the stopping tabs 45 prior to engagement with the contact portions 211 of the terminals. Thus the RJ-11 plug is blocked from full insertion by the stopping tabs 45 of anti-mismating device 4 and a reliable anti-mismating is obtained.

In addition, if the RJ-45 plug has a shield, the anti-mismating devise 4 will be electrically connect with the shield for Electro-Static Discharge (ESD) before the contacts of the RJ-45 plug electrically connect with the contact portions 211 of the terminals 2 when the RJ-45 plug is inserted into the electrical connector 100.

It is to be understood, however, that even though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. A receptacle connector for receiving a mating plug and blocking a relatively smaller second plug from being received, the receptacle connector comprising:

an insulative housing having a receiving cavity;

a plurality of terminals extending into the receiving cavity;

a metallic shield attached to the insulative housing; and an anti-mismating device being positioned in the housing and in contact with the shield, the device comprising a locking portion, an elbow extending downwardly and rearwardly from the locking portion and a stopping tab extending inwardly from the elbow;

wherein when the mating plug is inserted into the receiving cavity, the elbow is engaged and thus the stopping tab is deflected upwardly and out of the mating plug insertion direction thereby allowing the mating plug insertion into the receptacle connector, and when the second plug is inserted into the receiving cavity, the stopping tab is struck thereby preventing insertion thereof.

2. The receptacle connector according to claim 1, wherein the locking portion and the elbow form an acute angle therebetween.

3. The receptacle connector according to claim 1, wherein the housing has a sidewall defining a window therein and a retention groove adjacent to the window, the elbow and the stopping tab are inserted into the receiving cavity through the window and the locking portion being secured in the retention groove.

4. The receptacle connector according to claim 1, wherein the anti-mismating device has an insertion tab extending downwardly from the locking portion for abutting against the shield.

5. The receptacle connector according to claim 1, wherein the anti-mismating device further includes a retention portion extending downwardly from a distal end of the locking portion, and wherein the housing defines a second groove communicating with the retention groove for receiving the retention portion.

6. The receptacle connector according to claim 4, wherein the housing defines a slot beneath the retention groove for accommodating the insertion tab.

7. An electrical connector comprising:

an insulative housing including two opposite side walls with a receiving cavity therebetween;

a pair of windows formed in the corresponding side walls, respectively;

a plurality of terminals disposed in the receiving cavity; and a pair of anti-mismating devices inserted into the two opposite sides of the housing from the corresponding windows, respectively, each of said anti-mismating devices including an elbow obliquely extending into the receiving cavity with a stopping tab transversely extending therefrom; wherein said each of the anti-mismating devices defines in a relaxed manner a vertical dimension which is larger than that of the window so that a tip of the elbow is protectively hidden sideward behind the corresponding side wall after assembling for not being withdrawn from the corresponding window.

8. The connector according to claim 7, wherein each of said anti-mismating devices further includes a tab mechanically and electrically engaged with a metallic shield enclosing said housing.

9. The connector according to claim 7, wherein a metallic shield encloses said housing, and each of two opposite side plates of the shield defines an opening in communication with the corresponding window sideward.

10. The connector according to claim 9, wherein said opening is derived from stamping a board retention barb from the corresponding side plate.

* * * * *